US010020140B2

(12) United States Patent
Pan et al.

(10) Patent No.: US 10,020,140 B2
(45) Date of Patent: Jul. 10, 2018

(54) KEYBOARD DEVICE

(71) Applicant: PRIMAX ELECTRONICS LTD., Taipei (TW)

(72) Inventors: Chin-Sung Pan, Taipei (TW); Ming-Han Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 53 days.

(21) Appl. No.: 15/434,147

(22) Filed: Feb. 16, 2017

(65) Prior Publication Data

US 2018/0166232 A1 Jun. 14, 2018

(30) Foreign Application Priority Data

Dec. 14, 2016 (TW) ..... 105141380 A

(51) Int. Cl.

| | |
|---|---|
| ***H01H 13/14*** | (2006.01) |
| ***H01H 13/7065*** | (2006.01) |
| *H01H 13/705* | (2006.01) |
| *H01H 3/12* | (2006.01) |
| *H01H 13/83* | (2006.01) |

(52) U.S. Cl.

CPC ..... *H01H 13/7065* (2013.01); *H01H 3/125* (2013.01); *H01H 13/14* (2013.01); *H01H 13/705* (2013.01); *H01H 13/83* (2013.01)

(58) Field of Classification Search

CPC ..... H01H 3/125; H01H 13/83; H01H 13/705; H01H 13/14; H01H 13/70; H01H 9/26; H01H 13/72; H01H 25/00; H01H 25/04; H01H 1/02

USPC ..... 200/5 A, 344, 314, 345, 512, 312, 511, 200/245, 288; 400/490, 491, 491.2, 400/495.1, 496

See application file for complete search history.

(56) References Cited

U.S. PATENT DOCUMENTS

| | | | | |
|---|---|---|---|---|
| 5,278,371 A * | 1/1994 | Watanabe | ..... | H01H 3/125 200/344 |
| 5,823,325 A * | 10/1998 | Lin | ..... | H01H 3/125 200/344 |
| 6,137,071 A * | 10/2000 | Yeh | ..... | H01H 3/125 200/341 |
| 6,613,996 B2 * | 9/2003 | Lee | ..... | H01H 3/125 200/344 |
| 7,964,813 B2 * | 6/2011 | Ting | ..... | H01H 13/705 200/344 |

* cited by examiner

*Primary Examiner* — Ahmed Saeed

(74) *Attorney, Agent, or Firm* — Kirton McConkie; Evan R. Witt

(57) ABSTRACT

A keyboard device includes a base plate, plural keys and a membrane circuit board. The keys are connected with the base plate. The membrane circuit board is arranged between the keys and the base plate. The base plate includes at least one elastic vibration absorber corresponding to a keycap or a stabilizer bar of the corresponding key. While the keycap is moved downwardly relative to the base plate, the sound resulted from the collision between the keycap or the stabilizer bar and the membrane circuit board or the base plate is reduced. Consequently, the operating comfort to the user is enhanced.

15 Claims, 11 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. The membrane circuit board 12 comprises plural membrane switches 121 corresponding to the plural keys 10 and 10'. Each of the plural keys 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the base plate 11. Moreover, the elastic element 103 comprises a contacting part 1031.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the keycap 101 of the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L1 of the key 10' is much larger than the width W1 of the key 10'. The key 10' further comprises a first stabilizer bar 104, a second stabilizer bar 105 and a reinforcement element 106. The reinforcement element 106 is disposed on a bottom surface of the keycap 101. Moreover, the reinforcement element 106 is a substantially a rectangular ring-shape rod with plural bent segments. The reinforcement element 106 is used to increase the structural strength of the keycap 101 and prevent from the deformation or the rocking condition of the keycap 101 in response to the external force. The first stabilizer bar 104 comprises a first transverse bar part 1041 and two first hook parts 1042. The two first hook parts 1042 are located at two ends of the first stabilizer bar 104, respectively. The second stabilizer bar 105 comprises a second transverse bar part 1051 and two second hook parts 1052. The two second hook parts 1052 are located at two ends of the second stabilizer bar 105, respectively.

The base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first transverse bar part 1041 of the first stabilizer bar 104 and the second transverse bar part 1051 of the second stabilizer bar 105 are pivotally coupled to the keycap 101 of the key 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively. Moreover, all of the first stabilizer bar 104, the second stabilizer bar 105, the reinforcement element 106 and the base plate 11 are made of metallic material.

FIG. 4 schematically illustrates the actions of the first stabilizer bar and the second stabilizer bar of the keyboard device as shown in FIG. 1. While the keycap 101 of the key 10' is moved upwardly or downwardly relative to the base plate 11, the first stabilizer bar 104 is moved in the direction D11 or the direction D12 and rotated in the direction D13 or the direction D14. Similarly, the second stabilizer bar 105 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. While the keycap 101 of any key 10 or 10' is depressed and moved downwardly relative to the base plate 11, the keycap 101, the first transverse bar part 1041 of the first stabilizer bar 104, the second transverse bar part 1051 of the second stabilizer bar 105 and the reinforcement element 106 collide with the membrane circuit board 12. Under this circumstance, a click sound is generated. Especially, the sound is unpleasant noise to the user when the kinetic energy resulted from collision is transferred downwardly to the base plate 11. In other words, the conventional keyboard device needs to be further improved.

SUMMARY OF THE INVENTION

An object of the present invention provides a keyboard device having a function of reducing noise. A base plate includes at least one elastic vibration absorber corresponding to a keycap or a stabilizer bar. While the keycap is moved downwardly relative to the base plate, the sound from the collision between the keycap or the stabilizer bar and the membrane circuit board or the base plate is reduced by the at least one elastic vibration absorber. Consequently, the operating comfort to the user is enhanced.

In accordance with an aspect of the present invention, there is provided a keyboard device. The keyboard device includes plural keys, a base plate and a membrane circuit board. Each of the plural keys includes a keycap. At least one specified key of the plural keys includes a stabilizer bar. The stabilizer bar is pivotally coupled to the corresponding keycap. The plural keys and the stabilizer bar of the at least one specified key are connected with the base plate. The base plate includes at least one elastic vibration absorber corresponding to the keycap or the stabilizer bar of the at least one specified key. The membrane circuit board is arranged between the plural keys and the base plate. The membrane circuit board includes plural membrane switches corresponding to the plural keys. While the keycap of the at least one specified key is depressed and moved downwardly relative to the base plate, the at least one elastic vibration absorber absorbs kinetic energy of the keycap or the stabilizer bar of the at least one specified key.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
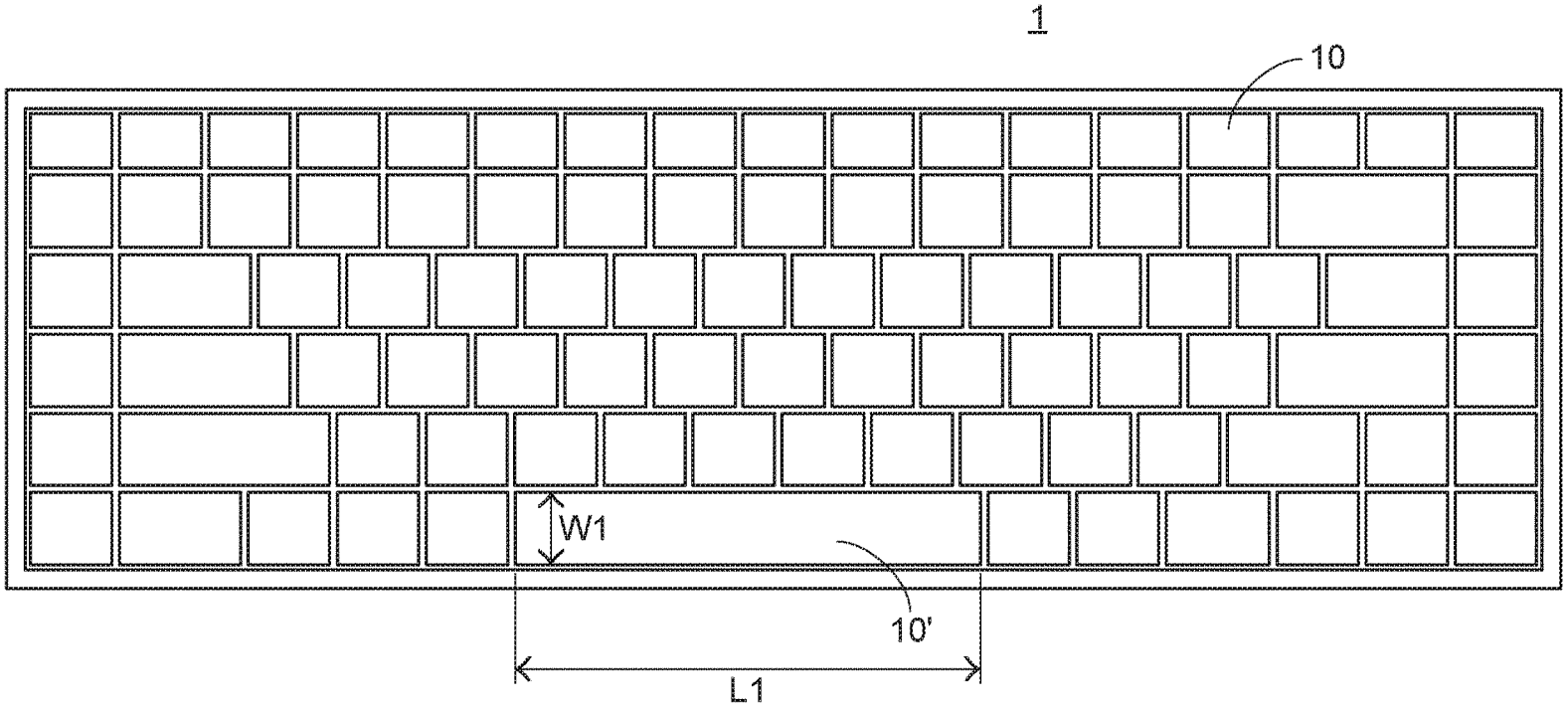
FIG. 1 PRIOR ART
FIG. 1 is a schematic top view illustrating the outer appearance of a conventional keyboard device.
Figure 2:
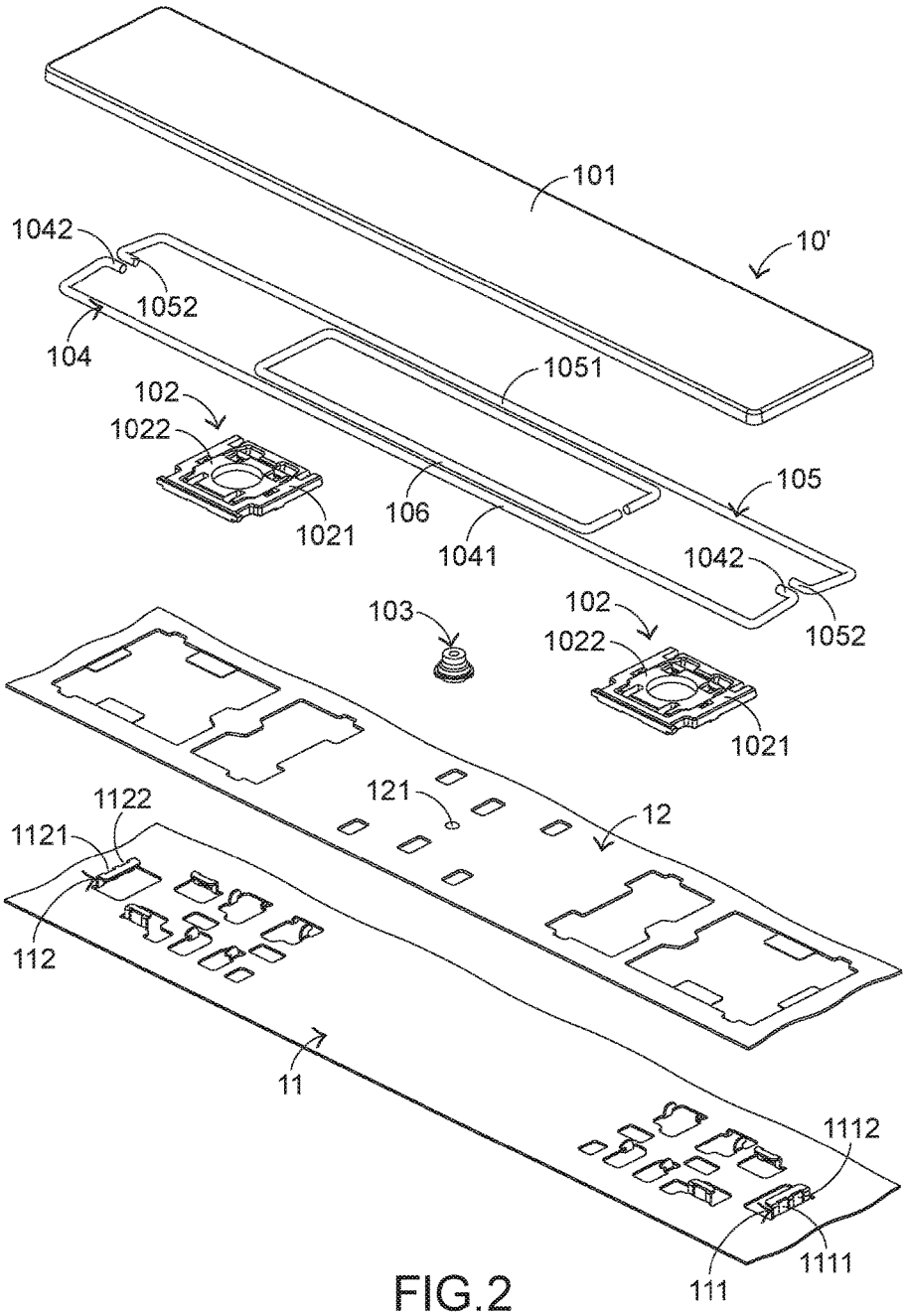
FIG.2 PRIOR ART
FIG. 2 is a schematic exploded view illustrating a portion of the keyboard device of FIG. 1 and taken along a viewpoint.
Figure 3:
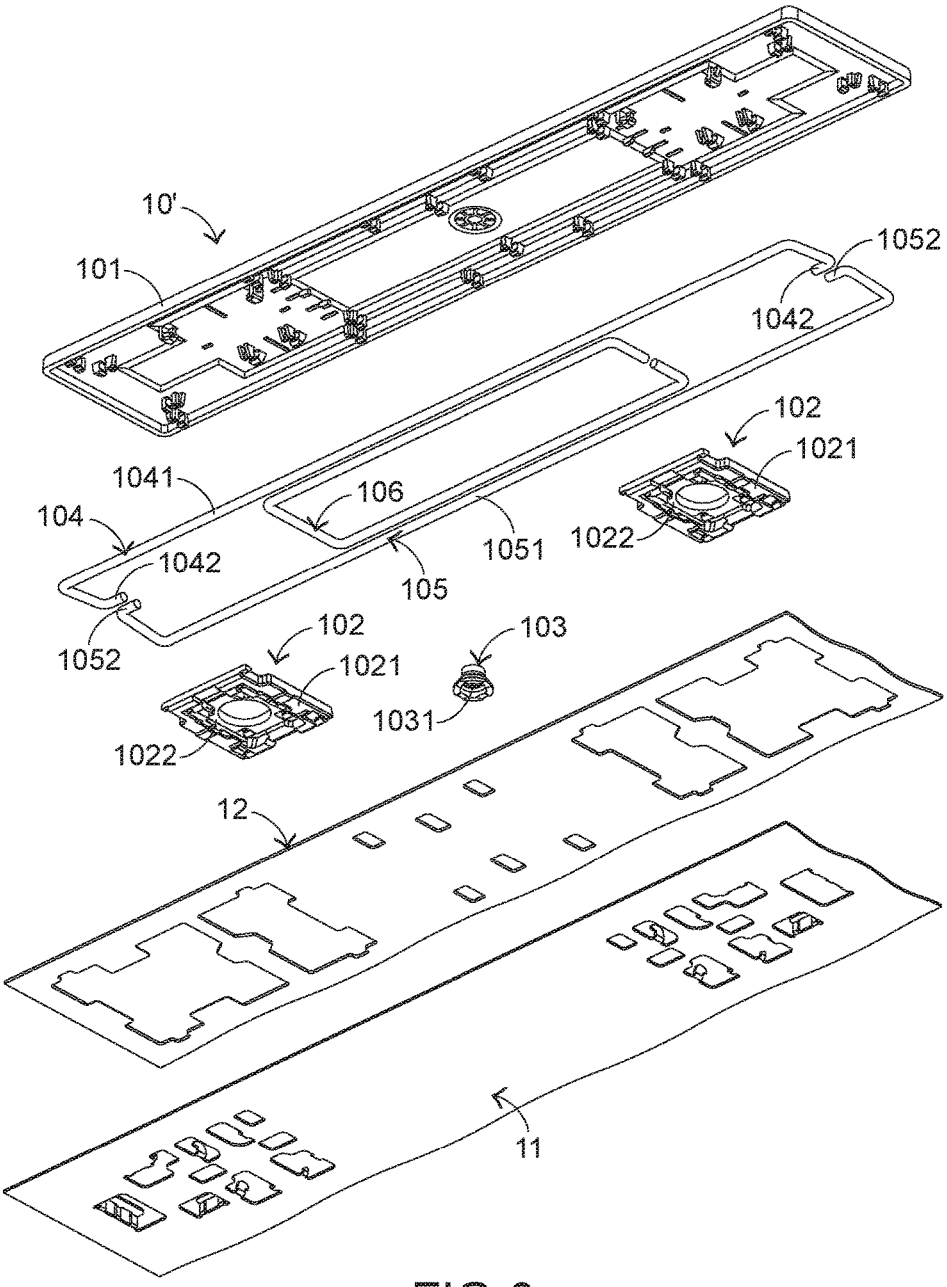
FIG.3 PRIOR ART
FIG. 3 is a schematic exploded view illustrating a portion of the keyboard device of FIG. 1 and taken along another viewpoint.
Figure 4:
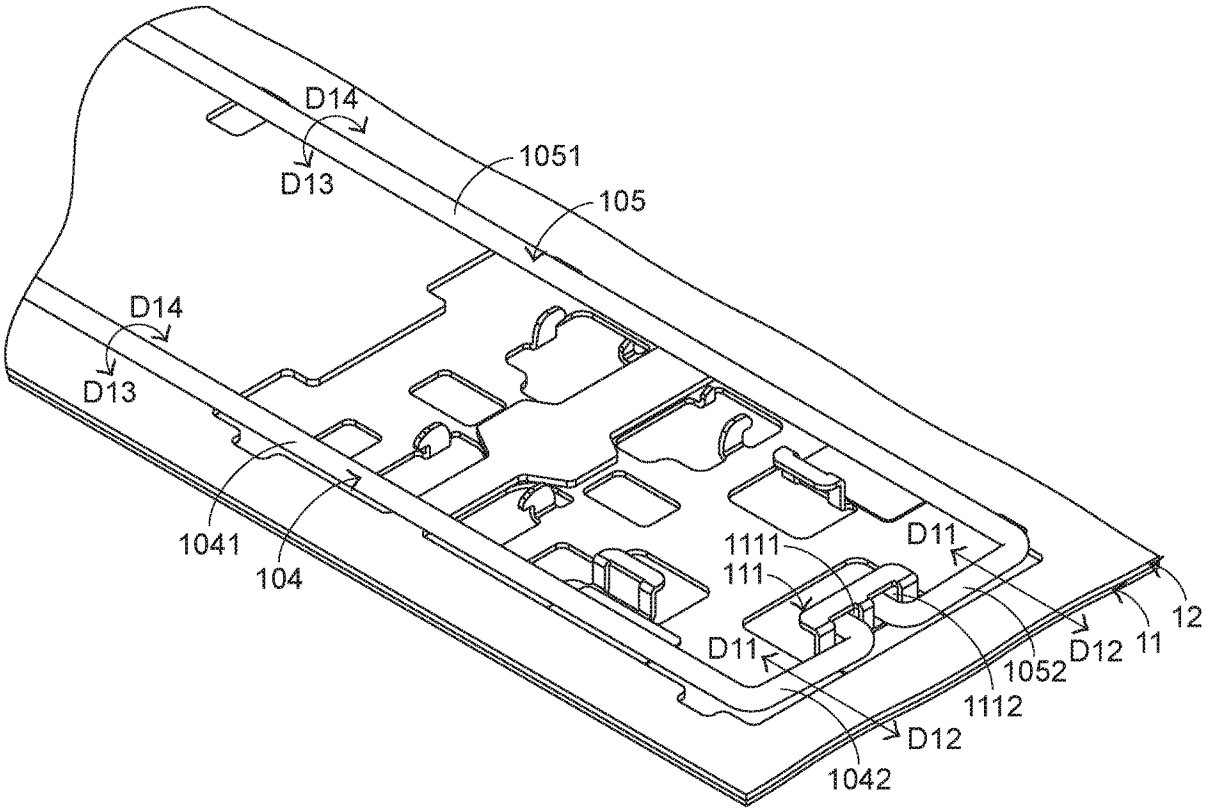
FIG.4 PRIOR ART
FIG. 4 schematically illustrates the actions of the first stabilizer bar and the second stabilizer bar of the keyboard device as shown in FIG. 1.
Figure 5:
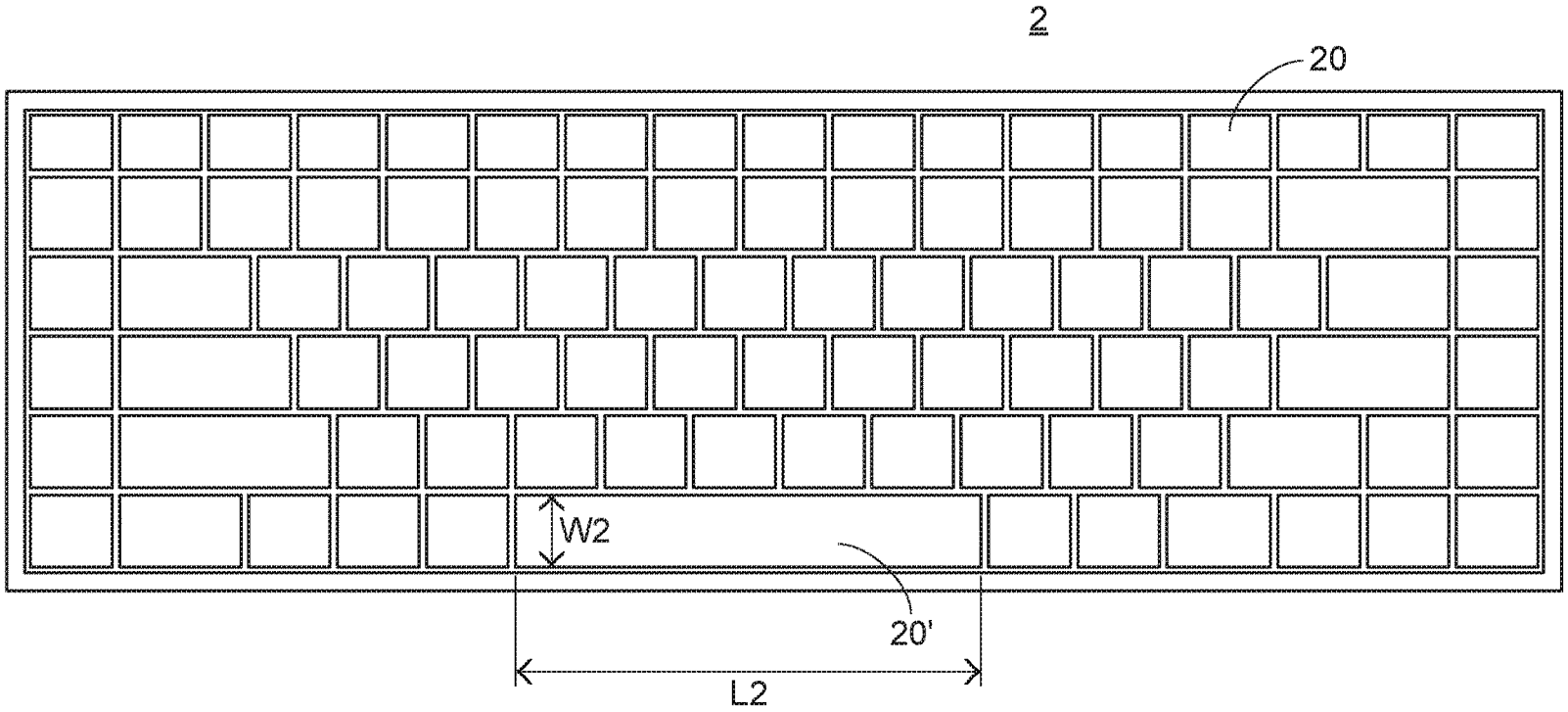
FIG. 5 is a schematic top view illustrating the outer appearance of a keyboard device according to a first embodiment of the present invention.
Figure 6:
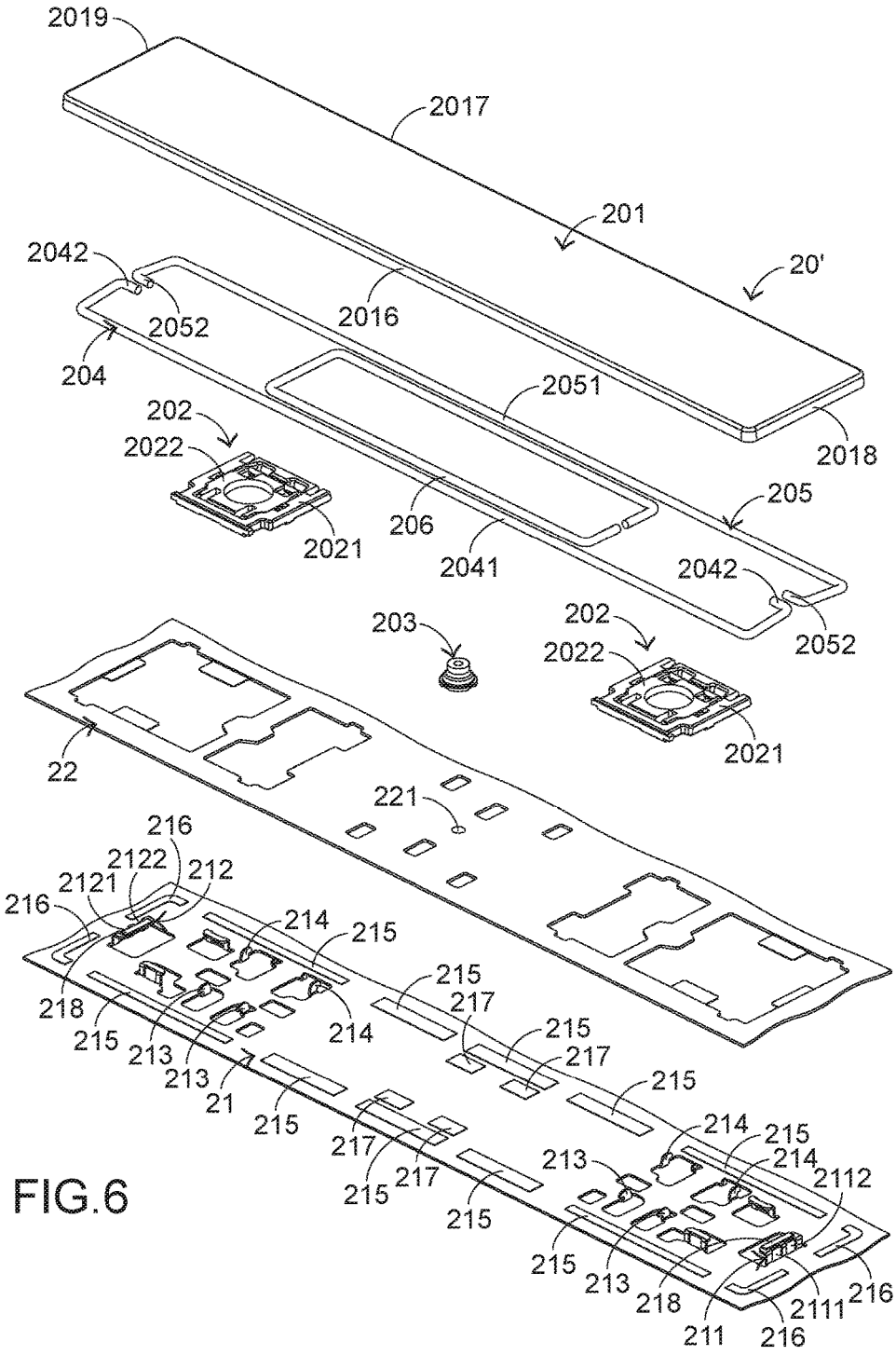
FIG. 6 is a schematic exploded view illustrating a portion of the keyboard device of FIG. 5 and taken along a viewpoint.
Figure 7:
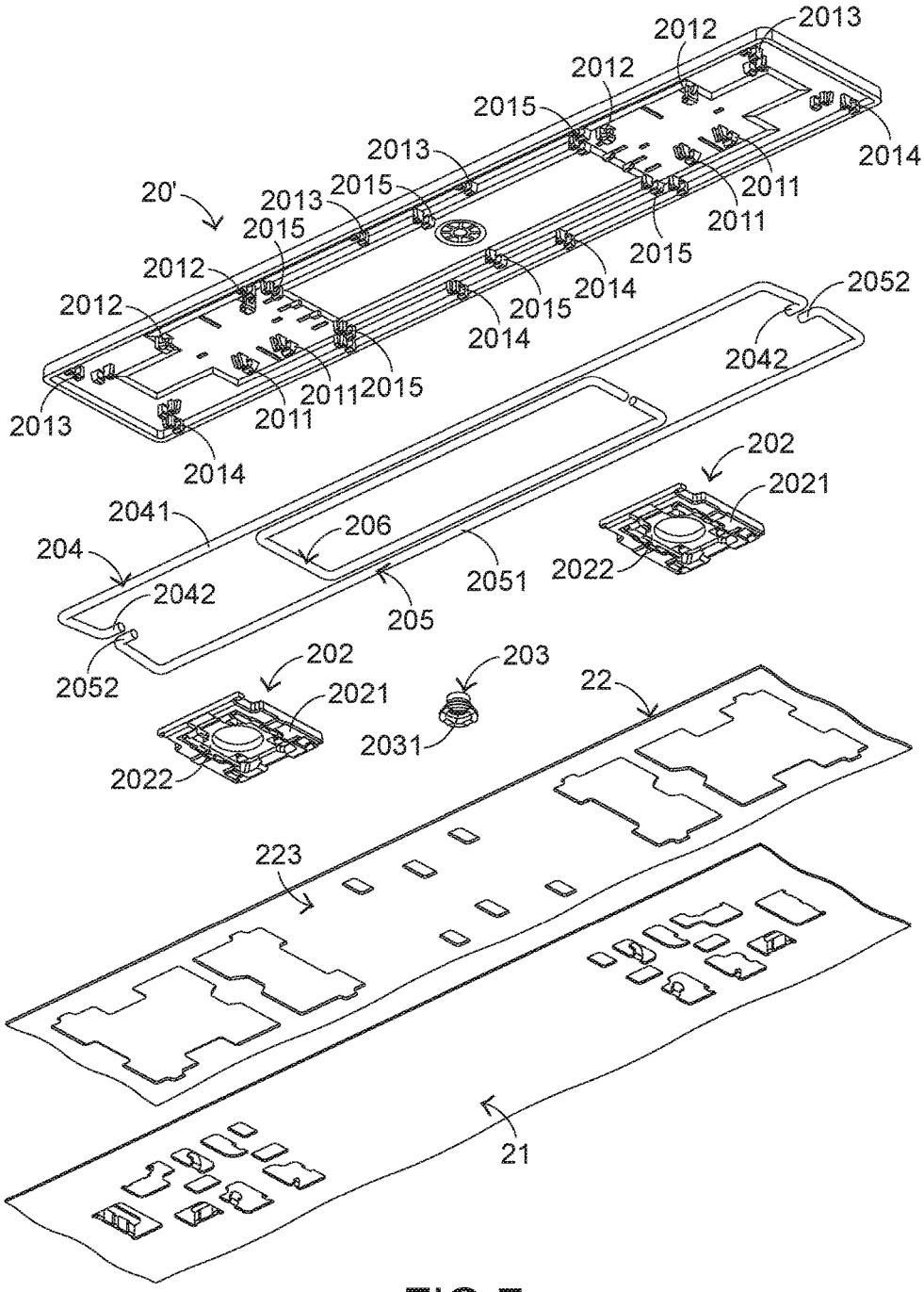
FIG. 7 is a schematic exploded view illustrating a portion of the keyboard device of FIG. 5 and taken along another viewpoint.

Please refer to FIGS. 5, 6 and 7. FIG. 5 is a schematic top view illustrating the outer appearance of a keyboard device according to a first embodiment of the present invention. FIG. 6 is a schematic exploded view illustrating a portion of the keyboard device of FIG. 5 and taken along a viewpoint. FIG. 7 is a schematic exploded view illustrating a portion of the keyboard device of FIG. 5 and taken along another viewpoint. For succinctness, only one key 20' and related components are shown in FIGS. 6 and 7.

The keyboard device 2 comprises plural keys 20 and 20', a base plate 21 and a membrane circuit board 22. The membrane circuit board 22 is arranged between the plural keys 20, 20' and the base plate 21. These keys 20 and 20' are classified into some types, e.g., ordinary keys, numeric keys and function keys. When one of the keys 20 and 20' is depressed by the user's finger, a corresponding key signal is generated to the computer, and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Figure 8:
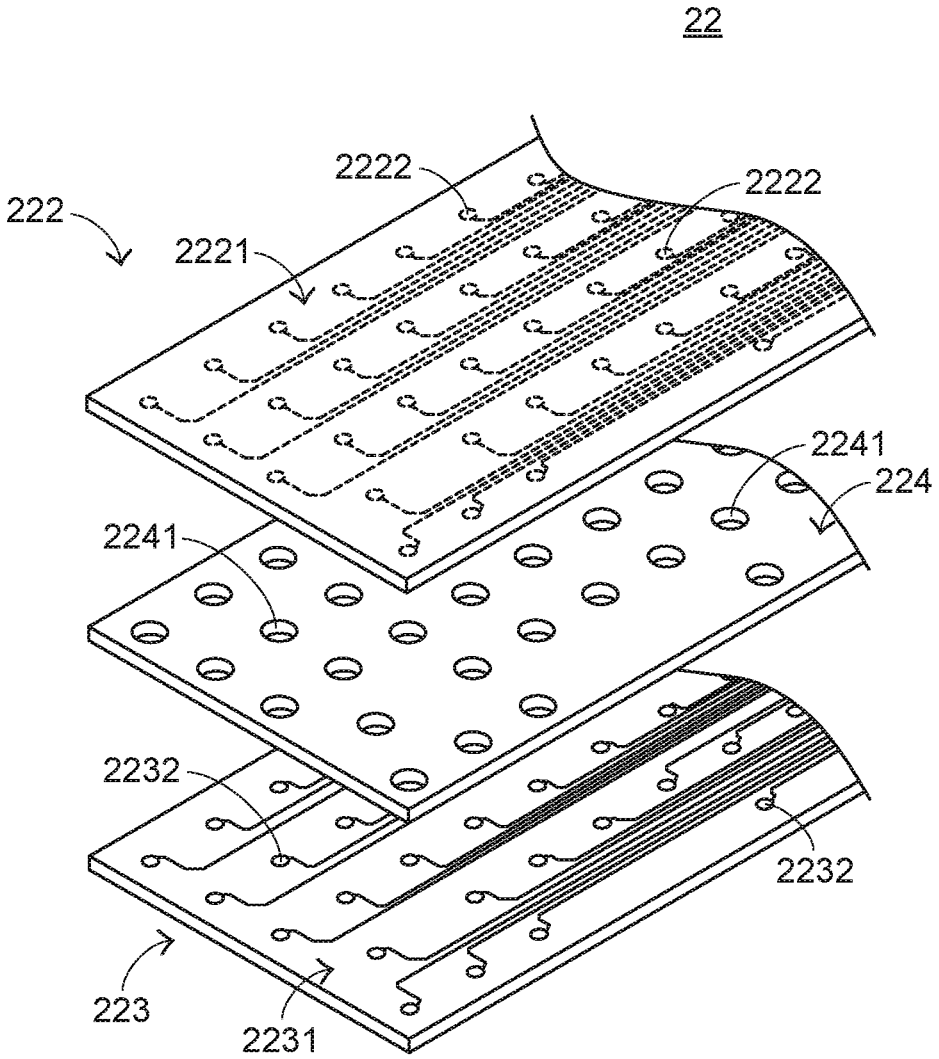
FIG. 8 is a schematic exploded view illustrating the membrane circuit board of the keyboard device as shown in FIG. 5.

FIG. 8 is a schematic exploded view illustrating the membrane circuit board of the keyboard device as shown in FIG. 5. The membrane circuit board 22 comprises plural film layers, which are arranged in a stack form. In this embodiment, the plural film layers of the membrane circuit board 22 comprise an upper film layer 222 and a lower film layer 223. A first circuit pattern 2221 is formed on a bottom surface of the upper film layer 222. The first circuit pattern 2221 comprises plural upper contacts 2222 corresponding to the plural keys 20 and 20'. A second circuit pattern 2231 is formed on a top surface of the lower film layer 223. The second circuit pattern 2231 comprises plural lower contacts 2232 corresponding to the plural upper contacts 2222. Each of the upper contacts 2222 and the corresponding lower contact 2232 are separated from each other by a spacing distance. Moreover, each of the upper contacts 2222 and the corresponding lower contact 2232 are collectively defined as a membrane switch 221. Moreover, for maintaining the spacing distance between each upper contact 2222 and the corresponding lower contact 2232, the membrane circuit board 22 further comprises an intermediate film layer 224. The intermediate film layer 224 is arranged between the upper film layer 222 and the lower film layer 223. In addition, the intermediate film layer 224 comprises plural perforations 2241 corresponding to the plural upper contacts 2222 and the plural lower contacts 2232. Preferably but not exclusively, at least one of the upper film layer 222, the lower film layer 223 and the intermediate film layer 224 is made of polycarbonate (PC), polyethylene terephthalate (PET), polymethylmethacrylate (PMMA), polyurethane (PU) or polyimide (PI).

Each of the plural keys 20 and 20' comprises a keycap 201, at least one connecting element 202 and an elastic element 203. The connecting element 202 is connected between the keycap 201 and the base plate 21. Through the connecting element 202, the keycap 201 is moved upwardly or downwardly relative to the base plate 21. The elastic element 203 is arranged between the keycap 201 and the base plate 21. Moreover, the elastic element 203 comprises a contacting part 2031. In this embodiment, the connecting element 202 is a scissors-type connecting element. Moreover, the connecting element 202 comprises a first frame 2021 and a second frame 2022. The second frame 2022 is pivotally coupled to the first frame 2021. Consequently, the first frame 2021 and the second frame 2022 can be swung relative to each other.

Each keycap 201 comprises a connecting lock part 2011 and a connecting hook part 2012. The base plate 21 comprises a first hook 213 and a second hook 214. The first hook 213 and the second hook 214 are protruded upwardly and penetrated through the membrane circuit board 22. A first end of the first frame 2021 is connected with the connecting lock part 2011 of the keycap 201. A second end of the first frame 2021 is connected with the second hook 214 of the base plate 21. A first end of the second frame 2022 is connected with the connecting hook part 2012 of the keycap 201. A second end of the second frame 2022 is connected with the first hook 213 of the base plate 21. The connecting relationships between the connecting element 202, the base plate 21 and the keycap 201 are presented herein for purpose of illustration and description only.

While the keycap 201 of any key 20 or 20' is depressed and moved downwardly relative to the base plate 21, the first frame 2021 and the second frame 2022 of the connecting element 202 are switched from an open-scissors state to a stacked state. Moreover, as the keycap 201 is moved downwardly to compress the elastic element 203, the corresponding upper contact 2222 is pushed and triggered by the contacting part 2031 of the elastic element 203. Consequently, the corresponding upper contact 2222 is contacted with the corresponding lower contact 2232 through the corresponding perforation 2241. In such way, the corresponding membrane switch 221 is electrically conducted, and the keyboard device 2 generates a corresponding key signal. When the keycap 201 of the key 20 or 20' is no longer depressed, the keycap 201 is moved upwardly relative to the base plate 21 in response to an elastic force of the elastic element 203. Meanwhile, the first frame 2021 and the second frame 2022 are switched from the stacked state to the open-scissors state again, and the keycap 201 is returned to its original position.

Please refer to FIGS. 6, 7 and 8 again. The length L2 of the key 20' is much larger than the width W2 of the key 20'. The key 20' further comprises a first stabilizer bar 204, a second stabilizer bar 205 and a reinforcement element 206. The reinforcement element 206 is disposed on a bottom surface of the keycap 201. Moreover, the reinforcement element 206 is a substantially a rectangular ring-shape rod with plural bent segments. The reinforcement element 206 is used to increase the structural strength of the keycap 201 and prevent from the deformation or the rocking condition of the keycap 201 in response to the external force. The first stabilizer bar 204 comprises a first transverse bar part 2041 and two first hook parts 2042. The two first hook parts 2042 are located at two ends of the first stabilizer bar 204, respectively. The second stabilizer bar 205 comprises a second transverse bar part 2051 and two second hook parts 2052. The two second hook parts 2052 are located at two ends of the second stabilizer bar 205, respectively.

As mentioned above, the length L2 of the key 20' is much larger than the width W2 of the key 20'. The keycap 201 of the key 20' further comprises plural first stabilizer lock parts 2013, plural second stabilizer lock parts 2014 and plural reinforcement lock parts 2015. The first transverse bar part 2041 is penetrated through the plural first stabilizer lock parts 2013 and pivotally coupled to the plural first stabilizer lock parts 2013. The second transverse bar part 2051 is penetrated through the plural second stabilizer lock parts 2014 and pivotally coupled with the plural second stabilizer lock parts 2014. The reinforcement element 206 is fixed on the keycap 201 through the plural reinforcement lock parts 2015.

The base plate 21 comprises a first connecting structure 211 and a second connecting structure 212. The first connecting structure 211 and the second connecting structure 212 are protruded upwardly, and penetrated through the membrane circuit board 22. The first connecting structure 211 comprises a first locking hole 2111 and a third locking hole 2112. The second connecting structure 212 comprises a second locking hole 2121 and a fourth locking hole 2122. The second locking hole 2121 corresponds to the first locking hole 2111, and the fourth locking hole 2122 corresponds to the third locking hole 2112. The two first hook parts 2042 of the first stabilizer bar 204 are penetrated through the first locking hole 2111 of the first connecting structure 211 and the second locking hole 2121 of the second connecting structure 212, respectively. The two second hook parts 2052 of the second stabilizer bar 205 are penetrated through the third locking hole 2112 of the first connecting structure 211 and the fourth locking hole 2122 of the second connecting structure 212, respectively.

Figure 9:
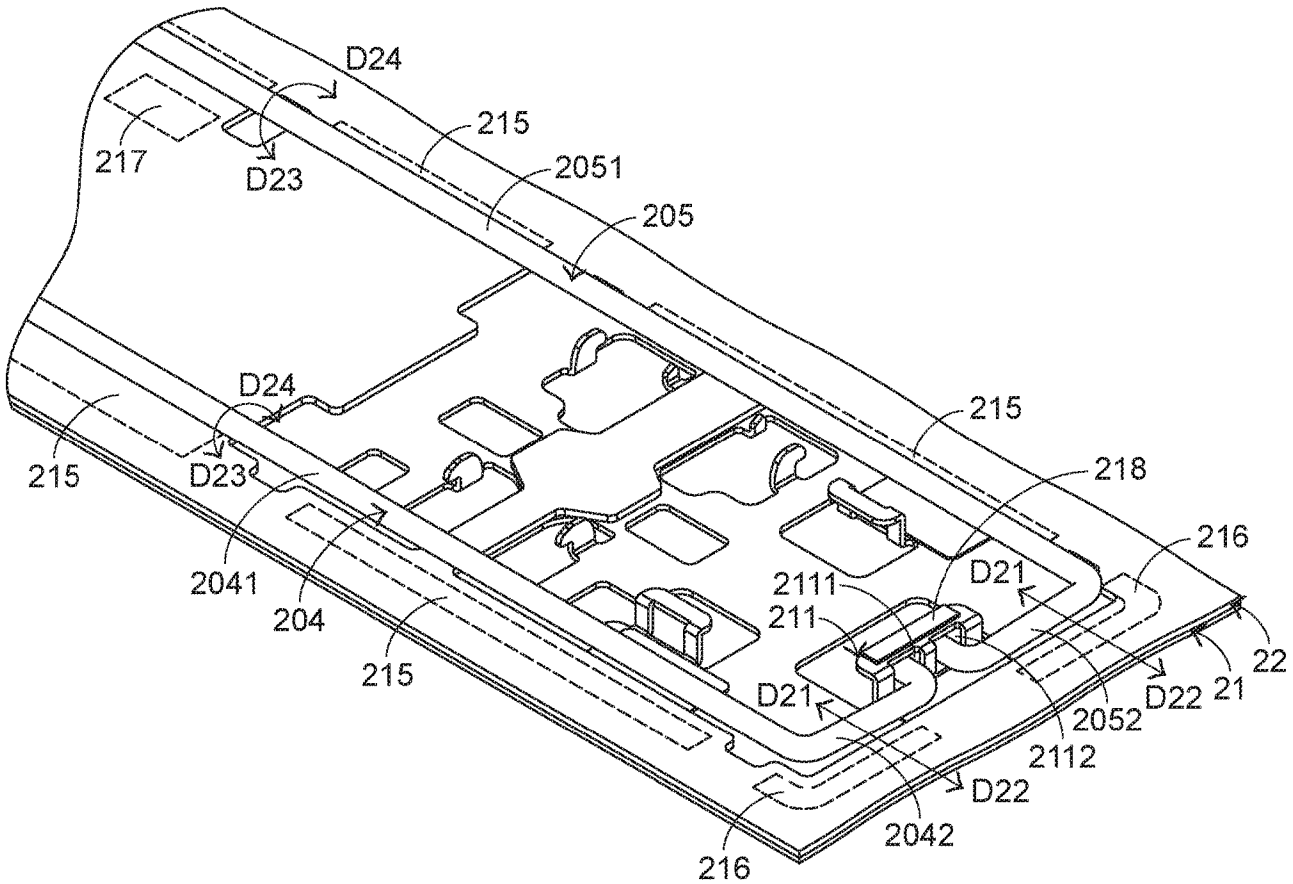
FIG. 9 schematically illustrates the actions of the first stabilizer bar and the second stabilizer bar of the keyboard device as shown in FIG. 5.

FIG. 9 schematically illustrates the actions of the first stabilizer bar and the second stabilizer bar of the keyboard device as shown in FIG. 5. While the keycap 201 of the key 20' is moved upwardly or downwardly relative to the base plate 21, the first stabilizer bar 204 is moved in the direction D21 or the direction D22 and rotated in the direction D23 or the direction D24, and the first transverse bar part 2041 of the first stabilizer bar 204 is rotated relative to the plural first stabilizer lock parts 2013. Similarly, the second stabilizer bar 205 is moved in the direction D21 or the direction D22 and rotated in the direction D23 or the direction D24, and the second transverse bar part 2051 of the second stabilizer bar 205 is rotated relative to the plural second stabilizer lock parts 2014. By this design, the key 20' is kept stable and not inclined while the key 20' is moved upwardly or downwardly relative to the base plate 21. Moreover, this design is helpful to increase the strength of the keycap 201.

Please refer to FIG. 6 again. The base plate 21 of the keyboard device 2 further comprises plural first elastic vibration absorbers 215, plural second elastic vibration absorbers 216, plural third elastic vibration absorbers 217 and plural fourth elastic vibration absorbers 218. In this embodiment, all of the plural first elastic vibration absorbers 215, the plural second elastic vibration absorbers 216, the plural third elastic vibration absorbers 217 and the plural fourth elastic vibration absorbers 218 are made of elastic material. An example of the elastic material includes but is not limited to silicone rubber or pressure sensitive adhesive (PSA). Preferably but not exclusively, the plural first elastic vibration absorbers 215, the plural second elastic vibration absorbers 216, the plural third elastic vibration absorbers 217 and the plural fourth elastic vibration absorbers 218 are formed on the base plate 21 by a screen printing process, a transfer printing process, a dispensing process or an adhesive attaching process.

The plural first elastic vibration absorbers 215 are disposed on a top surface of the base plate 21 and arranged between the base plate 21 and the membrane circuit board 22. Moreover, the plural first elastic vibration absorbers 215 are aligned with two opposite edges 2016 and 2017 of the keycap 201, the first transverse bar part 2041 of the first stabilizer bar 204 and the second transverse bar part 2051 of the second stabilizer bar 205. While the keycap 201 of any key 20 or 20' is depressed and moved downwardly relative to the base plate 21, the membrane circuit board 21 is collided by the two opposite edges 2016 and 2017 of the keycap 201, the first transverse bar part 2041 of the first stabilizer bar 204 and the second transverse bar part 2051 of the second stabilizer bar 205. Since the first elastic vibration absorbers 215 under the membrane circuit board 22 are capable of absorbing the kinetic energy of the keycap 201, the first stabilizer bar 204 and the second stabilizer bar 205, the impact resulted from the collision is alleviated. Consequently, the click sound to be transmitted to the base plate 21 is reduced.

The plural second elastic vibration absorbers 216 are also disposed on the top surface of the base plate 21 and arranged between the base plate 21 and the membrane circuit board 22. Moreover, the plural second elastic vibration absorbers 216 are aligned with the corners of the keycap 201 and two opposite edges 2018 and 2019 of the keycap 201. While the keycap 201 of any key 20 or 20' is depressed and moved downwardly relative to the base plate 21, the plural second elastic vibration absorbers 216 are collided by the corners and the two opposite edges 2018 and 2019 of the keycap 201. Since the second elastic vibration absorbers 216 under the membrane circuit board 22 are capable of absorbing the kinetic energy of the keycap 201, the impact resulted from the collision is alleviated. Consequently, the click sound to be transmitted to the base plate 21 is reduced.

The plural third elastic vibration absorbers 217 are also disposed on the top surface of the base plate 21 and arranged between the base plate 21 and the membrane circuit board 22. Moreover, the plural third elastic vibration absorbers 217 are aligned with the reinforcement element 206. While the keycap 201 of any key 20' is depressed and moved downwardly relative to the base plate 21, the plural third elastic vibration absorbers 217 are collided by the reinforcement element 206. Since the third elastic vibration absorbers 217 under the membrane circuit board 22 are capable of absorbing the kinetic energy of the reinforcement element 206, the impact resulted from the collision is alleviated. Consequently, the click sound to be transmitted to the base plate 21 is reduced.

The plural fourth elastic vibration absorbers 218 are disposed on a top surface of the first connecting structure 211 and a top surface of the second connecting structure 212. While the keycap 201 of any key 20' is depressed and moved downwardly relative to the base plate 21, the plural fourth elastic vibration absorbers 218 are collided by the bottom surface of the keycap 201. Since the fourth elastic vibration absorbers 218 are capable of absorbing the kinetic energy of the keycap 201, the impact resulted from the collision is alleviated. Consequently, the click sound to be transmitted to the base plate 21 is reduced.

Figure 10:
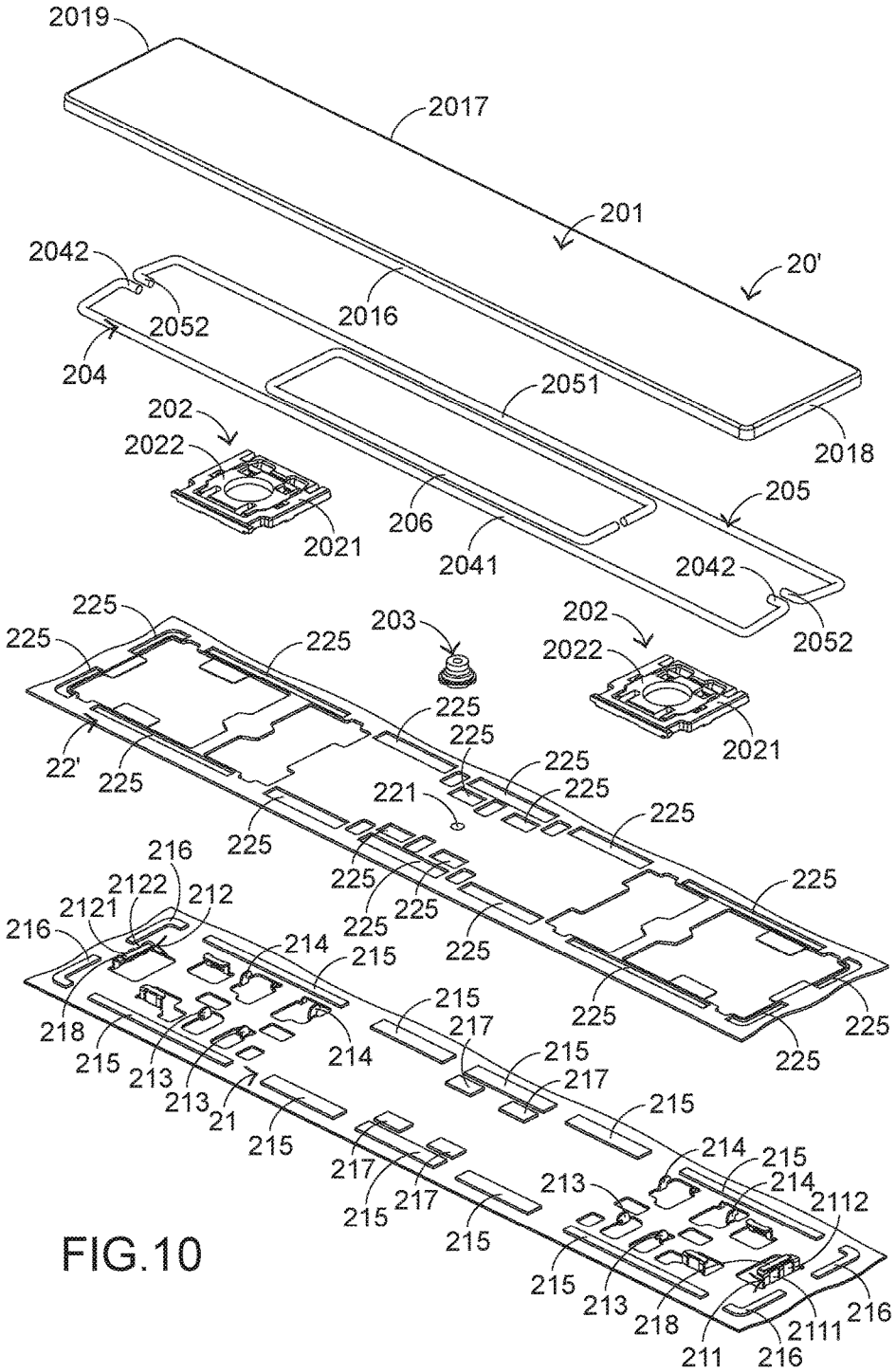
FIG. 10 is a schematic exploded view illustrating a portion of a keyboard device according to a second embodiment of the present invention.
Figure 11:
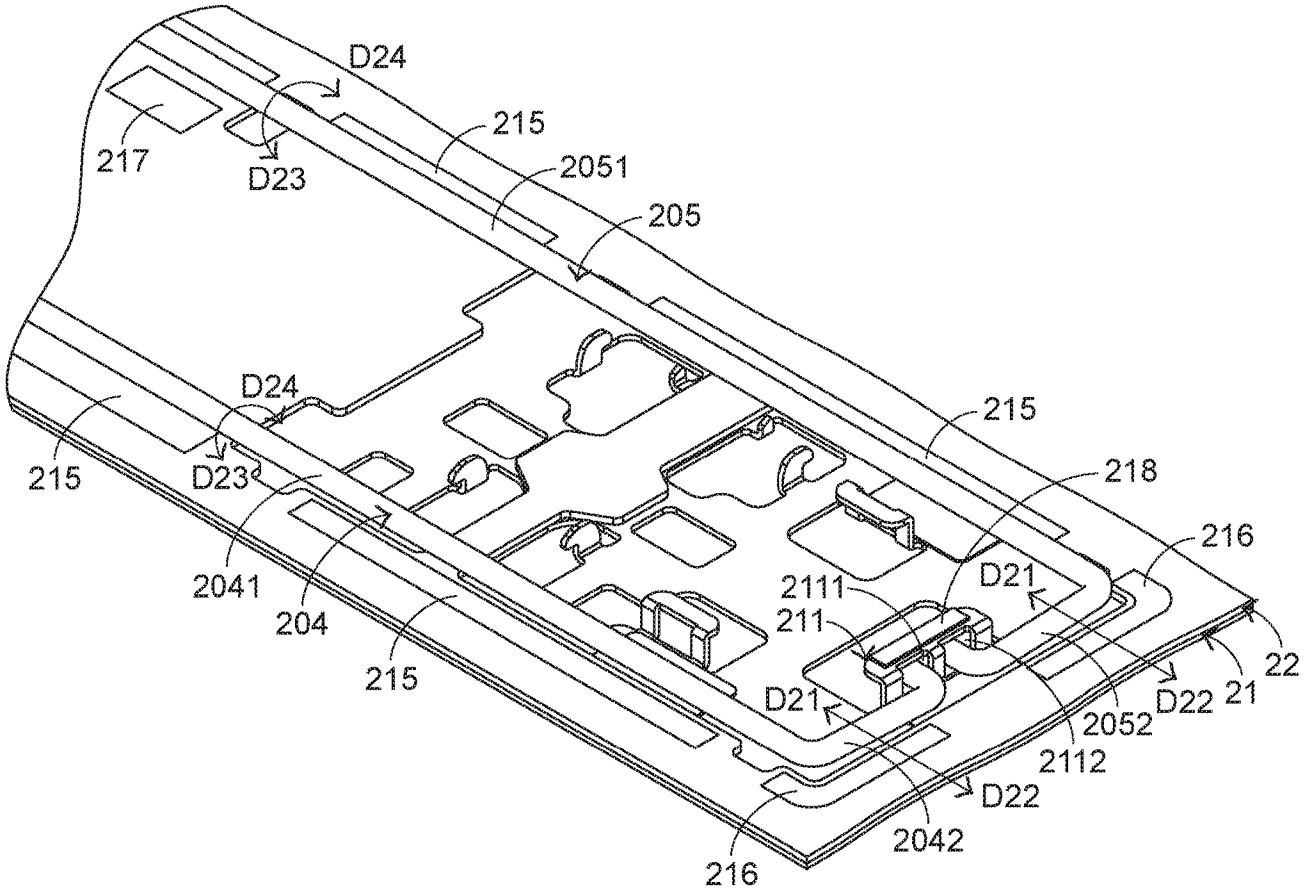
FIG. 11 schematically illustrates the actions of the first stabilizer bar and the second stabilizer bar of the keyboard device as shown in FIG. 10.

Please refer to FIGS. 10 and 11. FIG. 10 is a schematic exploded view illustrating a portion of a keyboard device according to a second embodiment of the present invention. FIG. 11 schematically illustrates the actions of the first stabilizer bar and the second stabilizer bar of the keyboard device as shown in FIG. 10. In comparison with the first embodiment, the membrane circuit board 22' of the keyboard device of this embodiment further comprises plural openings 225 corresponding to the plural first elastic vibration absorbers 215, the plural second elastic vibration absorbers 216, the plural third elastic vibration absorbers 217 and the plural fourth elastic vibration absorbers 218. The plural first elastic vibration absorbers 215, the plural second elastic vibration absorbers 216, the plural third elastic vibration absorbers 217 and the plural fourth elastic vibration absorbers 218 are penetrated through the corresponding openings 225. While the keycap 201 of any key 20 or 20' is depressed and moved downwardly relative to the base plate 21, these elastic vibration absorbers 215, 216, 217 and 218 are collided by the keycap 201, the first transverse bar part 2041 of the first stabilizer bar 204 and the second transverse bar part 2051 of the second stabilizer bar 205. Since these elastic vibration absorbers 215, 216, 217 and 218 are capable of absorbing the kinetic energy of the keycap 201, the first stabilizer bar 204 and the second stabilizer bar 205, the impact resulted from the collision is alleviated. Consequently, the click sound to be transmitted to the base plate 21 is reduced. The other components of the keyboard device of this embodiment are similar to those of the first embodiment, and are not redundantly described herein.

From the above descriptions, the present invention provides the keyboard device. In accordance with the present invention, plural elastic vibration absorbers are formed on the base plate by a screen printing process, a transfer printing process or a dispensing process. These elastic vibration absorbers are aligned with the keycap, the stabilizer bar or the reinforcement element. While the keycap moved downwardly relative to the base plate, the plural elastic vibration absorbers are collided by the keycap, the stabilizer bar or the reinforcement element. Since the impact on the membrane circuit board or the base plate is alleviated by the plural elastic vibration absorbers, the generated noise is reduced. Under this circumstance, the operating comfort to the user is enhanced, and the cost of fabricating the keyboard device with the noise reducing function is decreased. In other words, the keyboard device of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

plural keys, wherein each of the plural keys comprises a keycap, and at least one specified key of the plural keys comprises a stabilizer bar and a reinforcement element, wherein the stabilizer bar and the reinforcement element are pivotally coupled to the keycap;

a base plate, wherein the plural keys and the stabilizer bar of the at least one specified key are connected with the base plate, and the base plate comprises at least one elastic vibration absorber that is formed on a top surface of the base plate by a screen printing process; wherein the at least elastic vibration absorber comprises plural first vibration absorbers that are aligned with the keycap and the stabilizing bar; and plural third vibration absorbers that are aligned with the reinforcement element; and a membrane circuit board arranged between the plural keys and the base plate, and comprising plural membrane switches corresponding to the plural keys, wherein while the keycap of the at least one specified key is depressed and moved downwardly relative to the base plate, the at least one elastic vibration absorber absorbs kinetic energy of the keycap, the stabilizer bar and the reinforcement element of the at least one specified key.

2. The keyboard device according to claim 1, wherein the at least one elastic vibration absorber is made of silicone rubber or pressure sensitive adhesive (PSA).

3. The keyboard device according to claim 1, wherein the at least one elastic vibration absorber is arranged between the base plate and the membrane circuit board.

4. The keyboard device according to claim 1, wherein the at least one elastic vibration absorber is disposed on a top surface of the base plate, and the membrane circuit board further comprises at least one opening corresponding to the at least one elastic vibration absorber, wherein the at least one elastic vibration absorber is penetrated through the at least one opening so as to be collided by the keycap or the stabilizer bar of the at least one specified key.

5. The keyboard device according to claim 1, wherein the reinforcement element is a substantially a rectangular ring-shape rod with plural bent segments, and the keycap of the at least one specified key further comprises a reinforcement lock part, wherein the rectangular ring-shape rod is fixed on the keycap through the reinforcement lock part.

6. The keyboard device according to claim 1, wherein the membrane circuit board comprises an upper film layer and a lower film layer, wherein a first circuit pattern is formed on the upper film layer, a second circuit pattern is formed on the lower film layer, the first circuit pattern comprises plural upper contacts, and the second circuit pattern comprises plural lower contacts, wherein the upper contacts and the lower contacts are separated from each by a spacing distance and collectively defined the membrane switches.

7. The keyboard device according to claim 6, wherein at least one of the upper film layer and the lower film layer is made of polycarbonate (PC), polyethylene terephthalate (PET), polymethylmethacrylate (PMMA), polyurethane (PU) or polyimide (PI).

8. The keyboard device according to claim 1, wherein the stabilizer bar comprises a transverse bar part and a hook part, the hook part is located at an end of the transverse bar part, and the transverse bar part is pivotally coupled to the corresponding keycap, wherein the base plate comprises a connecting structure, the connecting structure is protruded upwardly from the base plate and comprises a locking hole, and the hook part of the stabilizer bar is penetrated through the locking hole.

9. The keyboard device according to claim 8, wherein the keycap of the at least one specified key further comprises a stabilizer lock part, and the transverse bar part is penetrated through the stabilizer lock part and pivotally coupled to the stabilizer lock part, wherein while the keycap of the at least one specified key is moved upwardly or downwardly relative to the base plate, the transverse bar part is rotated relative to the stabilizer lock part.

10. The keyboard device according to claim 8, wherein the at least one elastic vibration absorber further comprises plural second elastic vibration absorbers that are disposed on the top surface of the base plate, and plural fourth elastic vibration absorbers that are disposed on a top surface of the connecting structure, wherein while the at least one elastic vibration absorber is collided by the keycap of the at least one specified key, the at least one elastic vibration absorber absorbs kinetic energy of the keycap.

11. The keyboard device according to claim 1, wherein each of the plural keys further comprises a connecting element, and the connecting element is connected between the base plate and the keycap, wherein the keycap is movable upwardly or downwardly relative to the base plate through the connecting element.

12. The keyboard device according to claim 11, wherein the connecting element is a scissors-type connecting element comprising a first frame and a second frame, and the second frame is pivotally coupled to the first frame.

13. The keyboard device according to claim 12, wherein the keycap comprises a connecting lock part and a connecting hook part, wherein the connecting lock part is connected with an end of the first frame, and the connecting hook part is connected with an end of the second frame.

14. The keyboard device according to claim 12, wherein the base plate further comprises plural first hooks and plural second hooks, and the plural first hooks and the plural second hooks are protruded upwardly, wherein each of the plural first hooks is connected with an end of the second frame, and each of the plural second hooks is connected with an end of the first frame.

15. The keyboard device according to claim 1, wherein each of the plural keys further comprises an elastic element, and the elastic element is arranged between the keycap and the membrane circuit board and comprises a contacting part, wherein while the keycap is depressed, the elastic element is compressed and a membrane switch is pushed by the contacting part, wherein when the keycap is not depressed, the keycap is returned to an original position in response to an elastic force provided by the elastic element.

* * * * *